US006531812B2

(12) United States Patent
Ko

(10) Patent No.: US 6,531,812 B2
(45) Date of Patent: Mar. 11, 2003

(54) SHADOW MASK FOR FLAT CATHODE RAY TUBE

(75) Inventor: Sung Woo Ko, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 09/731,845

(22) Filed: Dec. 8, 2000

(65) Prior Publication Data

US 2001/0045795 A1 Nov. 29, 2001

(30) Foreign Application Priority Data

Dec. 9, 1999 (KR) ..... 99 56249

(51) Int. Cl.[7] ..... H01J 29/80
(52) U.S. Cl. ..... 313/402; 313/403; 313/408
(58) Field of Search ..... 313/403, 402, 313/407, 408

(56) References Cited

U.S. PATENT DOCUMENTS 5,825,435 A * 10/1998 Vriens et al. ..... 313/364

FOREIGN PATENT DOCUMENTS

KR 9830605 7/2000

WO 9611490 4/1996

* cited by examiner

*Primary Examiner*—Robert H. Kim
*Assistant Examiner*—Elizabeth Gemmell
(74) *Attorney, Agent, or Firm*—Birch, Stewart, Kolasch & Birch, LLP

(57) ABSTRACT

Disclosed is a shadow mask for a flat cathode ray tube capable of achieving the decrement of the phenomena of moire and the improvement of luminance and controlling a bridge shadow thereof, with an optimal design value of the vertical pitch of the apertures of the shadow mask. The shadow mask for a flat cathode ray tube has a panel glass with fluorescent materials spread on the inner surface thereof, a funnel glass fixed on the rear portion of the panel glass and having a neck portion as an integral body therewith to which an electron gun emitting electron beams to the fluorescent materials side is sealed, a deflection yoke formed on the outer peripheral surface of the neck portion and for deflecting the electron beams emitted from the electron gun, and the shadow mask fixed on the inner surface of the panel glass, having a color discrimination function and forming a plurality of slot type apertures on the surface thereof, is characterized in that the relation between the vertical pitch of the apertures on the shadow mask and the vertical pitch of the electron beams scanned on the screen is in the range of $0.053 \leqq s/a \leqq 0.438$.

2 Claims, 3 Drawing Sheets

SHADOW MASK FOR FLAT CATHODE RAY TUBE

BACKGROUND OF THE INVENTION

FIELD OF THE INVENTION

The present invention relates to a shadow mask for a flat cathode ray tube and more particularly, to a shadow mask for a flat cathode ray tube capable of achieving the decrement of the phenomena of moire and the improvement of luminance and controlling a bridge shadow thereof.

DISCUSSION OF RELATED ART

Generally, a display device is made to provide information not in an audible manner but in a visible manner, such that it should be designed based upon the characteristics of the eyes of man. In other words, a determination standard for a quality of the display device is the eyes of man.

On the other hand, the eyes of the man can distinguish the difference of colors and brightness, and in case of scientifically explaining the capability of distinguishing the difference of brightness repeated regularly, two factors are used: an angular spatial frequency; and a modulation depth. In more detail, the angular spatial frequency factor is determined based upon the interval of the period repeated regularly and the viewing distance, and the modulation depth factor indicates the degree of the difference of brightness.

Furthermore, the eyes of man can distinguish the difference of brightness at a specific frequency band, even if the difference is negligibly small, but they fail to distinguish the difference of brightness at another specific frequency band, even if the difference is substantially large. This can be checked in FIG. 3.

In this case, a vertical pitch of electron beams and a vertical pitch of a shadow mask, as commonly used, are positioned at a frequency band which is not sensitive to the eyes of man. Therefore, the respective vertical pitches are not sensed to the eyes of man, but their interaction enables the wavelength thereof to be extended to thereby form a new pattern that is sensitive to the eyes of man.

In other words, it is natural that the superposition of two waves having different periods from each other produces a wave having new period and amplitude. Such the principle of superposition appears in a color cathode ray tube which adopts a shadow mask and is deflected by a deflection yoke to execute a sequential scanning, which is called the phenomena of 'moire'.

In order to remove the phenomena of moire appearing on the screen, on the other hand, a previously determined scanning manner is fixed and then, a vertical pitch of the shadow mask or spot shape and profile of the electron beams should be well designed. However, it is really difficult to design the electron beams capable of having the characteristics meeting the removal of the phenomena of moire in connection with various kinds of other characteristics.

Therefore, most of designers give their concentration on improving a quality of the shadow mask, and to analyze and design the shadow mask, Fourier series and Fourier transform are generally used.

The phenomena of moire mentioned in the present invention are the phenomena of raster moire appearing as the horizontally striped patterns on the screen.

On the other hand, FIG. 1 shows the configuration of a general flat cathode ray tube.

As shown in FIG. 1, the general flat cathode ray tube includes: a panel glass 3; a shadow mask 5 that is fixed on the reverse surface of the panel glass 3 in the state where a tension force is applied to a fixed rail (which is omitted in the drawing) by a frit glass and has a plurality of apertures of round or slot shape functioning to discriminate colors of the electron beams; a magnetic shield 6 that is secured on the inner surface of the panel glass 3 and serves to prevent the ways of the electron beams from being changed due to an external earth magnetic field or a leaking magnetic field; a funnel glass 4 that is fixed on the panel glass 3 by means of the frit glass and formed integrally with a neck portion on the rear portion thereof; an electron gun 1 that is sealed into the neck portion of the funnel glass 4 and emits the electron beams of R, G and B colors; and a deflection yoke 2 that is adapted to surround the outer peripheral surface of the neck portion and deflect the electron beams.

Now, an explanation of the construction and operation of each part provided in the general flat cathode ray tube will be discussed.

First, the electron gun 1 is composed of: a cathode that is made of a metal such as a carbonate, nickel and so on, for producing electrons; a heater that supplies a thermal energy to thereby lower the thermal energy of the carbonate of the cathode, with a result that the electron emission can be well carried out; a G1 electrode that determines a beam spot size when the electron beams are focused on a screen; a G2 electrode that regulates a voltage for drawing the electrons crowded in a cloud pattern around the cathode; a pre-focusing electrode that performs a pre-focusing for a bundle of electron beams emitted extensively from the cathode; a focusing electrode that serves as a main lens for enabling the electron beams to be focused on the screen in an accurate manner; and an accelerating electrode that accelerates the electrons such that the motion energy of the electrons can be great, thereby making the screen brighten.

The deflection yoke 2 is composed of: horizontal and vertical coils that are adapted to deflect the electron beams of the R, G and B colors horizontally and vertically; a ferrite core that is adapted to increase the efficiency of the magnetic force produced in the each coil and make the magnetic field positioned in the inside of the deflection yoke to thereby prevent the magnetic field from leaking; and a circuit terminal that is adapted to carry out a fine convergence for the three electron beams that have not been converged on the coils.

The panel glass 3 has thickness and curvature of a predetermined value or more, in order to have a vacuum intensity resistant to an atmospheric pressure, since the tube has an internal pressure of 10-7 torr approximating the vacuum state.

Additionally, the panel glass 3 is provided with R. G and B fluorescent materials and a black matrix (BM) which are spread on the internal surface thereof, for the purpose of visibly displaying desired information. An aluminum film is also formed on the fluorescent materials in a vacuum-evaporation manner for the purpose of enhancing the light emitting efficiency of the fluorescent materials and maintaining the voltage within the tube at a predetermined level. The funnel glass 4 into the neck portion of which the electron gun 1 is inserted and on the outer peripheral surface of the neck portion of which the deflection yoke 2 is inserted is spread with graphite as a conductive material on the internal surface thereof, such that the electrons are not affected by the external electric field. Therefore, the interior of the tube is made of a complete conduction film, thereby making the electric field thereof '0'.

The shadow mask 5 forms the plurality of apertures 7 function to discriminate R. G and B fluorescent material light emitting electron beams that are scanned by as high as twice that of a horizontal pitch Hp of a general mask and land the resulting electron beams at a predetermined position on the screen.

The magnetic shield 6 is of a magnetic material which draws the magnetic field flowing to the interior of the tube and flows it through the shield, in order to prevent the paths of the electron beams from being changed due to the variation of the magnetic field.

In the general flat cathode ray tube under the above construction, on the other hand, the electron beams are scanned from left to right and from top and to bottom, sequentially, and the vertical pitch of the electron beams scanned horizontally and the vertical pitch (i.e., the pitch on the vertical arrangement) of the apertures 7 formed on the shadow mask 5 are interacted to necessarily cause the phenomena of moire forming wave patterns, which results in the deterioration of a quality of screen and the reduction of reliability of the product.

Therefore, the shadow mask 5 should be designed in consideration of various kinds of factors, as shown in FIG. 2, that is, a horizontal pitch Hp of the apertures 7 related to resolution, a vertical pitch a of the apertures 7 related to the moire and luminance, a slot width Sw related to a purity margin and a bridge width Bw related to the structural strength of the shadow mask 5 and the luminance, to thereby calculate an optimal design value for the vertical pitch of the apertures 7 formed on the shadow mask 5.

In the conventional tube, the optimal design value for the vertical pitch of the apertures 7 formed on the shadow mask 5 is calculated by using the following moire expression:

$$\lambda - \left|\frac{n}{s} - \frac{2m}{a}\right|^{-1} Mm - \left|\frac{Sm\left(\pi m\left(1 - \frac{2w}{a}\right)\right)}{\pi m\left(1 - \frac{w}{a}\right)}\right| \mathrm{Exp}\left(-\frac{2\pi^2 n^2 \sigma^2}{s^2}\right)$$

wherein, 'λ' represents a wavelength of moire, 'Mm' a modulation depth of the wavelength of moire, 's' the size of the vertical pitch of the electron beams scanned horizontally, 'a' the vertical pitch of the apertures of the shadow mask, 'w' a bridge width, 'σ' a vertical spot size of the electron beams (which is assumed as Gaussian distribution), 'n' a harmonic index number at the time when the scanned beams are indicated by Fourier series, and 'm' a harmonic index number at the time when the vertical arrangement of the apertures of the shadow mask is indicated by Fourier series.

According to the above expression, in case of the color display tube (CDT) using resolution modes of generally 640×480, 800×600, 1024×768, 1260×1024, 1600×1200 and the like, the tube having a length of for example 17 inches uses the vertical pitch of the mask in the range of 0.23 mm to 0.32 mm, it having a length of for example 19 inches uses that in the range of 0.25 mm to 0.33 mm, and it having a length of for example 21 inches uses that in the range of 0.30 mm to 0.37 mm.

At this time, the vertical pitch is resistant to the phenomena of moire even in the case where the size of the electron beam in the vertical direction is small, since the spot size of the electron gun 1 is of a horizontally extended shape in view of its focus characteristic.

A color picture tube (CPT) using an NTSC system, a PAL system and so on uses the vertical pitch of the shadow mask of 1.5 mm or less.

For example, in case of the CPT having a length of 21 inches using the PAL system, the graph as shown in FIG. 4 is obtained if the above moire expression is employed.

This case is considered only when m=1, n=1 and m=1 and n=2, where the modulation depth is large. This shows the fact that the area of the vertical pitch a of the apertures of the shadow mask at a ratio of the vertical pitch a of the apertures of the shadow mask to the vertical pitch s of the electron beams scanned horizontally, which is described in Japanese Patent Publication Application No. 9-506497 and at a ratio of the vertical pitch a of the apertures of the shadow mask to the vertical pitch s of the electron beams scanned horizontally, which is described in Korean Patent Application No. 98-30605 corresponds to the area of the vertical pitch of the apertures of the shadow mask for avoiding the moire.

In other words, it can be found from the graph as shown in FIG. 4 that the area of the vertical pitch in the range of $0.725 \leqq s/a \leqq 0.8$ or $1.175 \leqq s/a \leqq 1.325$ as described in the Japanese Patent Publication Application No. 9-506497 and in the range of $0.37 \geqq s/a$ as described in the Korean Patent Application No. 98-30605 corresponds to the area of the vertical pitch of the apertures of the shadow mask for avoiding the moire. The vertical pitch of is the apertures of the shadow mask in the above ranges can reduce the phenomena of moire, when adapted in the flat cathode ray tube.

More particularly, in case of the Japanese Patent Publication Application No. 9-506497, if the vertical pitch in the range of 0.715 mm to 0.79 mm is used, the phenomena of moire can be reduced, and in case of the Korean Patent Application No. 98-30605, if the vertical pitch of 1.55 mm or more is used, the moire can be reduced, which can be checked in the graph as shown in FIG. 4.

In case of the Japanese Patent Publication Application No. 9-506497, however, the moire has been reduced, but there occurs a disadvantage that no influence on the luminance as a basic characteristic of a display device has been given. In case of the Korean Patent Application No. 98-30605, on the other hand, the moire has been reduced and the luminance has been improved. However, there occurs a disadvantage that the bridge shadow which is sensitive to the eyes of man is generated as the vertical pitch of the apertures of the shadow mask is high.

That is, the bridge means the area ranged between the apertures 7 in the vertical arrangement and if the vertical pitch of the apertures of the shadow mask is high, appears in a shadow shape on the screen, which can be sensed by the eyes of man.

At this time, the bridge shadow is estimated by a contrast threshold function (hereinafter, referred to as CTF), the spatial frequency of the bridge and the modulation depth. There are various expressions on the CTF, a representative example of which is as follows:

$$CTF(\upsilon) = \frac{\beta_0 \exp(\beta_1 \upsilon + \beta_2 \upsilon^2 + \beta_3 \upsilon^4)}{1 - \exp(-\upsilon)}$$

Wherein, $$\beta_0 = 1.70623 \times 10^{-3}\left(1 - 1.45 \exp\left(-\frac{Lum}{0.1541}\right)\right),$$

$$\beta_1 = 0.195\left(0.22 \exp\left(-\frac{Lum}{1.393}\right)\right),$$

-continued $$\beta_2 = -2.3210\times10^{-3}\left(1+2.87\exp\left(-\frac{Lum}{1.36}\right)\right) \text{ and}$$

$$\beta_3 = 3.0\times10^{-7}\left(1+4.8\exp\left(-\frac{Lum}{3.73}\right)\right).$$

Another example of the expression on the CTF is as follows:

$$CTF(u)=b_0EXP(b_1u+b_2u^2+b_3u^4)$$

Wherein, 'D' represents a viewing distance and $b_0=1.7062\times10^{-3}$, $b_1=0.2016188$, $b_2=-2.3161\times10^{-3}$ and $b_3=2.0000\times10^{-7}$.

And, the spatial frequency and the modulation depth relative to the bridge shadow are given by the following expression:

$$M(\xi,\eta)=\frac{aH}{ph}\frac{aV}{pv}Stn(aH\xi,aV\eta)$$

Wherein, $$\xi=\frac{\pi}{180}\frac{D}{2ph} \text{ and } \eta=\frac{\pi}{180}\frac{2D}{pv}.$$

On the other hand, if the value of the M(ξ,ζ)/CTF(ξ,ζ) calculated by the M(ξ,ζ) and CTF(ξ,ζ) obtained from the above expressions is greater than '1', a probability that the bridge shadow is sensitive to the eyes of man is high and if smaller than '1', the probability is low.

Therefore, upon designing the vertical pitch a of the apertures of the shadow mask 5, it is important to make the value of the M(ξ,ζ)/CTF(ξ,ζ) smaller than '1', thereby carrying out the control of the bridge shadow, together with the reduction of the phenomena of moire and the improvement of luminance.

SUMMARY OF THE INVENTION

An object of the invention is to provide a shadow mask for a flat cathode ray tube capable of achieving the decrement of the phenomena of moire and the improvement of luminance and controlling a bridge shadow thereof, with an optimal design value of the vertical pitch of the apertures thereon.

To accomplish this and other objects of the present invention, there is provided a shadow mask for a flat cathode ray tube having a panel glass with fluorescent materials spread on the inner surface thereof, a funnel glass fixed on the rear portion of the panel glass and having a neck portion as an integral body therewith to which an electron gun emitting electron beams to the fluorescent materials side is sealed, a deflection yoke formed on the outer peripheral surface of the neck portion and for deflecting the electron beams emitted from the electron gun, and the shadow mask fixed on the inner surface of the panel glass, having a color discrimination function and forming a plurality of slot type apertures on the surface thereof, characterized in that the relation between the vertical pitch a of the apertures thereon and the vertical pitch s of the electron beams scanned on the screen is in the range of $0.053\leqq s/a\leqq0.438$.

BRIEF DESCRIPTION OF THE ATTACHED DRAWINGS

DETAILED DESCRIPTION OF PREFERRED EMBODIMENT

Figure 1:
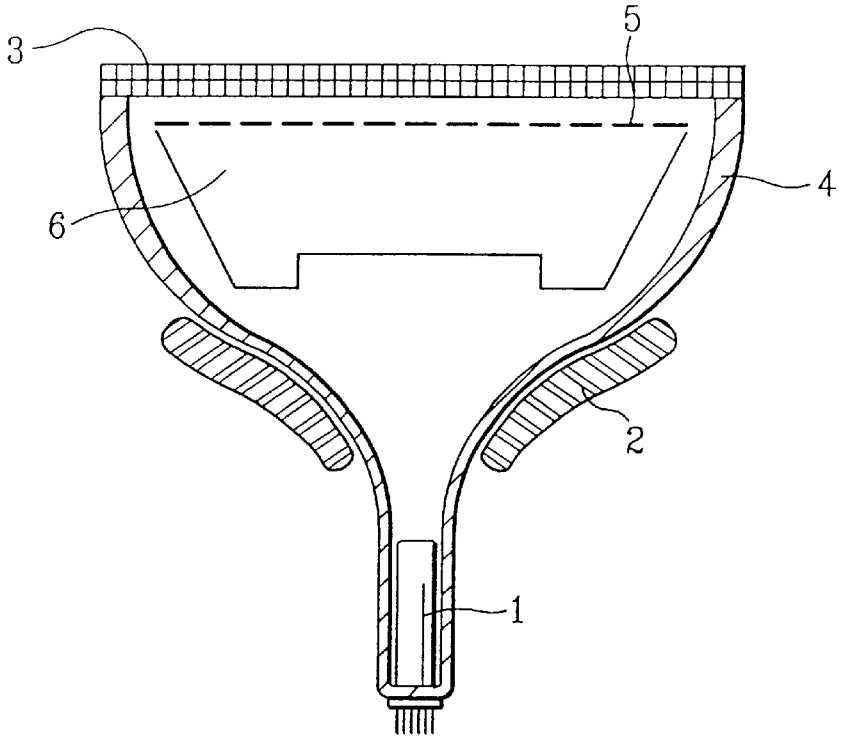
FIG.1 BACKGROUND ART
FIG. 1 is a longitudinal sectional view illustrating the configuration of a general flat cathode ray tube.
Figure 2:
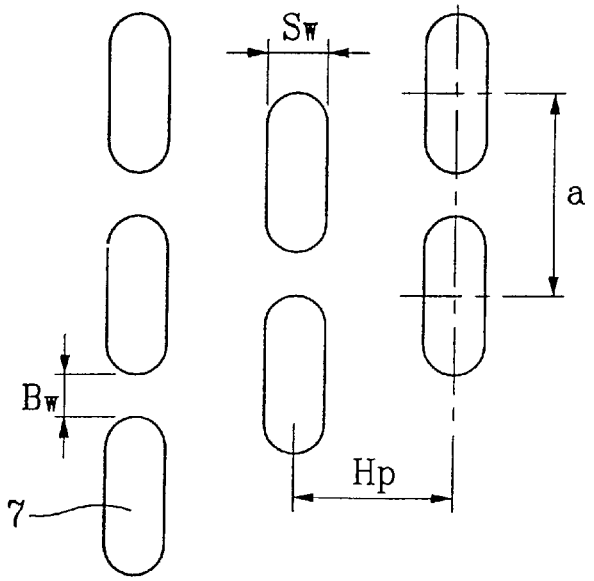
FIG.2 BACKGROUND ART
FIG. 2 shows the structure of the apertures formed on the shadow mask in FIG. 1.
Figure 3:
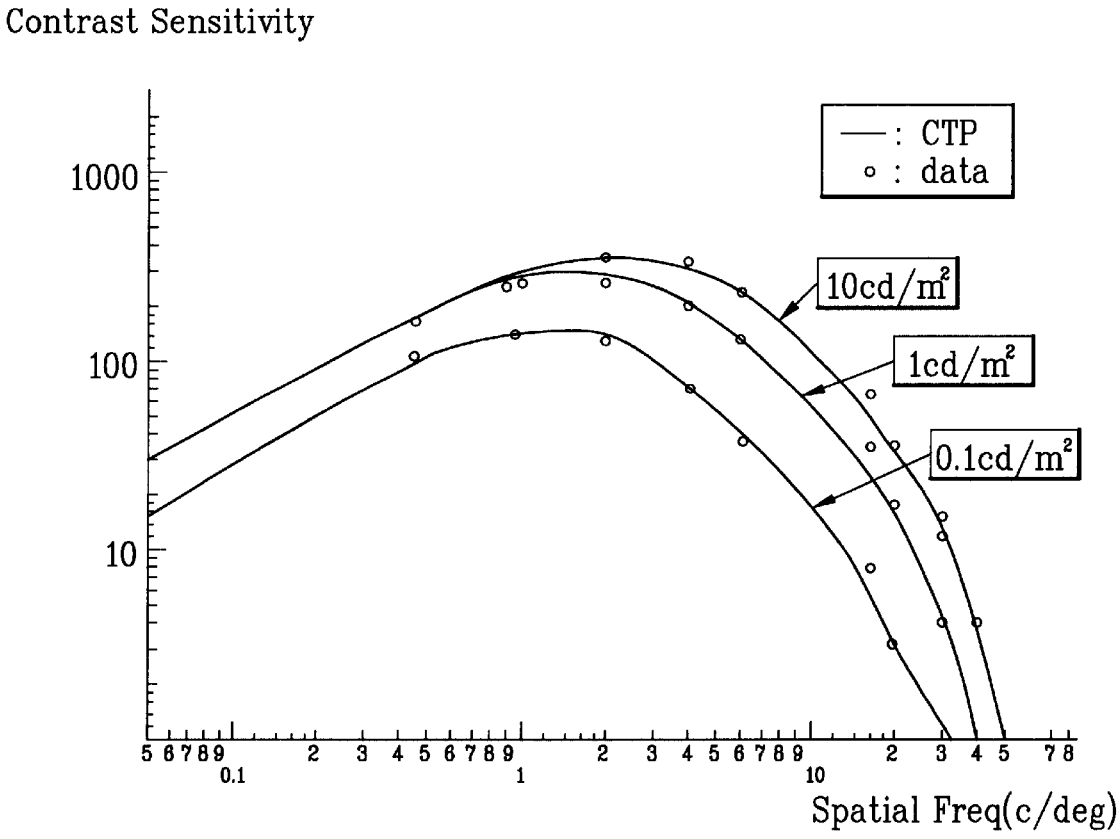
FIG. 3 is a graph illustrating the relation between each frequency and contrast sensitivity for explaining the characteristics of the eyes of man.
Figure 4:
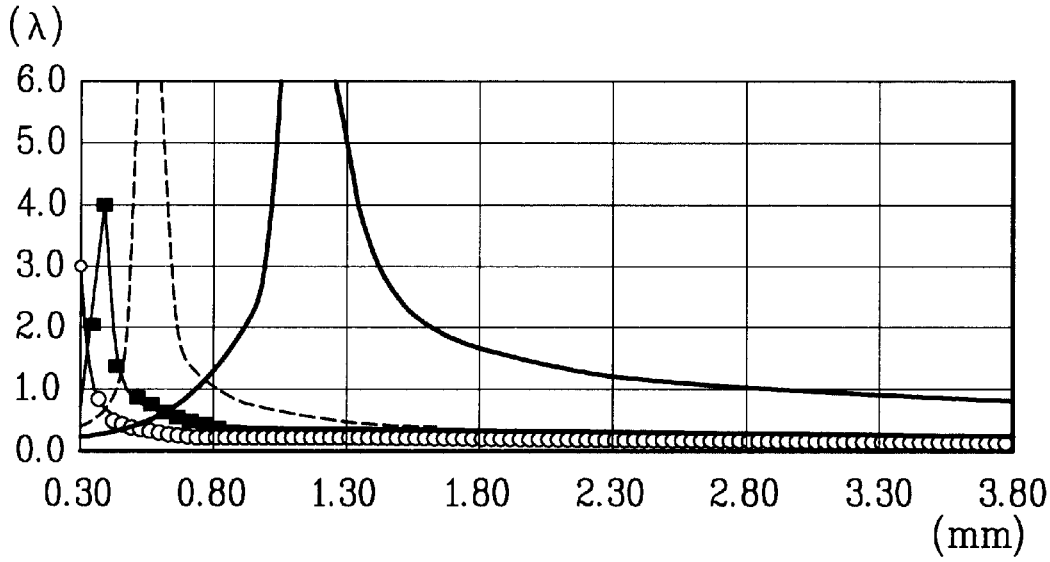
FIG. 4 is a graph illustrating the relation between the vertical pitch and wavelength of the shadow mask.

Hereinafter, a shadow mask for a flat cathode ray tube according to the present invention will be in detail discussed with reference to FIGS. 1 to 5.

According to the present invention, the shadow mask for a flat cathode ray tube including a panel glass 3 with fluorescent materials spread on the inner surface thereof, a funnel glass 4 fixed on the rear portion of the panel glass 3 and having a neck portion as an integral body therewith to which an electron gun 1 emitting electron beams to the fluorescent materials side is sealed, a deflection yoke 2 formed on the outer peripheral surface of the neck portion and for deflecting the electron beams emitted from the electron gun 1, and the shadow mask 5 fixed on the inner surface of the panel glass 3, having a color discrimination function and forming a plurality of slot type apertures 7 on the surface thereof, is characterized in that the relation between the vertical pitch a of the apertures 7 on the shadow mask 5 and the vertical pitch s of the electron beams scanned on the screen is in the range of $0.053\leqq s/a\leqq0.438$.

Under the above configuration, an operation of the present invention is as follows:

As noted above, the phenomena of moire appear by periodic properties of the vertical pitch of the electron beams scanned on the screen and the vertical arrangement of the apertures 7 of the shadow mask 5. In other words, if two waves having strengths of a predetermined value and periodic properties are multiplexed, a wave having a strength of a new value and a new period is formed.

At this time, the shadow mask 5 serves to block or pass the electron beams scanned at a predetermined vertical pitch.

If the dimension of the vertical pitch of the electron beams scanned is similar to that of the vertical pitch of the shadow mask 5 to thereby have a relatively low difference value, the interaction therebetween is enormously active to produce a new pattern having a wavelength that is sensitive to the eyes of man. To the contrary, if the dimension of the vertical pitch of the electron beams scanned is different from that of the vertical pitch of the shadow mask 5 to thereby have a relatively high difference value, the interaction therebetween is substantially inactive to produce the unchanged pattern having its original wavelength. However, if the vertical pitch of the shadow mask 5 is low, the luminance on the screen is deteriorated and hence, if the phenomena of moire are to be reduced, the vertical pitch a of the apertures of the shadow mask 5 should be remarkably higher than the vertical pitch s of the electron beams scanned.

Therefore, the relatively low wavelength on the screen indicates the electron beams scanned and the relatively high wavelength indicates the vertical arrangement of the apertures of the shadow mask 5.

At this time, the electron beams scanned have the short wavelength and the modulation depth does not have a large value enough to be sensitive to the eyes of man, thereby making it impossible to be sensitive to the eyes of man. On the other hand, the vertical arrangement of the apertures of the shadow mask 5 has the long wavelength which is sensitive to the eyes of man but is not sensitive to the eyes of man, considering the modulation depth.

If the vertical pitch of the shadow mask 5 is increased over a predetermined value, however, it has such the wavelength as being sensitive to the eyes of man, thereby failing to perform a basic function as a display device. In this way, the vertical pitch of the apertures 7 of the shadow mask 5 appears at a ratio of the vertical pitch a of the apertures 7 of the shadow mask 5 to the vertical pitch s of the electron beams scanned on the screen, in place of its own value. The ratio has to be in a predetermined range ($r_{min}<s/a<r_{max}$), such that the phenomena of moire are reduced and at the same time, the bridge shadow appearing on the screen is not sensitive to the eyes of man.

In this case, the values of $r_{min}$ and $r_{max}$ are varied in accordance with the size of the screen of the tube and the number of scannings of the electron beams, but in the preferred embodiment of the present invention, they are in the range of $0.053 \leqq r_{min} \leqq 0.098$, $0.369 \leqq r_{max} \leqq 0.438$. At this time, the bridge shadow appearing on the screen is not sensitive to the eyes of man.

As noted above, the values of $r_{min}$ and $r_{max}$ are varied in accordance with the size of the screen of the tube and the number of scannings of the electron beams. Generally, the smaller the size of the screen is and the larger the number of scannings, the larger the values thereof become.

So, in case where the ratio of the vertical pitch a of the apertures 7 of the shadow mask 5 to the vertical pitch s of the electron beams scanned on the screen is in the range of $0.053 \leqq s/a \leqq 0.438$, the phenomena of moire and the bridge shadow are all avoided.

Now, a detailed explanation of the contents of the present invention will be discussed.

Upon designing the shadow mask of the flat cathode ray tube, in order to avoid the phenomena of moire, the vertical pitch of the shadow mask is designed in different values in consideration of the vertical size of the flat cathode ray tube and the number of scannings of the electron beams. Also, in case of the flat cathode ray tube for TV, the vertical pitch of the shadow mask is designed in different values in consideration of the vertical size of the flat cathode ray tube and the NTSC or PAL transmitting system. In other words, the vertical pitch of the shadow mask is designed in different values in accordance with the size of the screen, the number of scannings or the scanning method. In case of the flat cathode ray tube for TV, for example, an explanation of the designing of the vertical pitch of the shadow mask will be hereinafter discussed.

For example, in case of the flat cathode ray tube having a length of 21 inches, if it uses the NTSC transmitting system, the relation between the vertical pitch a of the apertures 7 of the shadow mask 5 and the vertical pitch s of the electron beams scanned on the screen is in the range of $0.091 \leqq s/a \leqq 0.350$, and if it uses the PAL transmitting system, the relation therebetween is in the range of $0.076 \leqq s/a \leqq 0.382$, such that the phenomena of moire and bridge shadow are all avoided.

And, in case of the flat cathode ray tube having a length of 15 inches, if it uses the NTSC transmitting system, the relation between the vertical pitch a of the apertures 7 of the shadow mask 5 and the vertical pitch s of the electron beams scanned on the screen is in the range of $0.063 \leqq s/a \leqq 0.398$, and if it uses the PAL transmitting system, the relation therebetween is in the range of $0.056 \leqq s/a \leqq 0.411$, such that the phenomena of moire and bridge shadow are all avoided.

It can be found from the above cases that the use range of the vertical pitch of the shadow mask becomes large as the size of the cathode ray tube is small and the number of scannings is large in the PAL system.

In case of the TV broadcasting, since the transmitting method is varied in different areas, the vertical pitch of the shadow mask may be designed by the selection of a specific transmitting system, but it is desirable that the range of the vertical pitch satisfying all cases is $0.053 \leqq s/a \leqq 0.438$, as mentioned above.

Only with the above range of the vertical pitch, the flat cathode ray tube can be of course designed to avoid the phenomena of moire and the bridge shadow, but it is more desirable that the accurate range of the vertical pitch all satisfying the above cases, without any allowable error in designing and manufacturing process is $0.098 \leqq s/a \leqq 0.369$.

Figure 5:
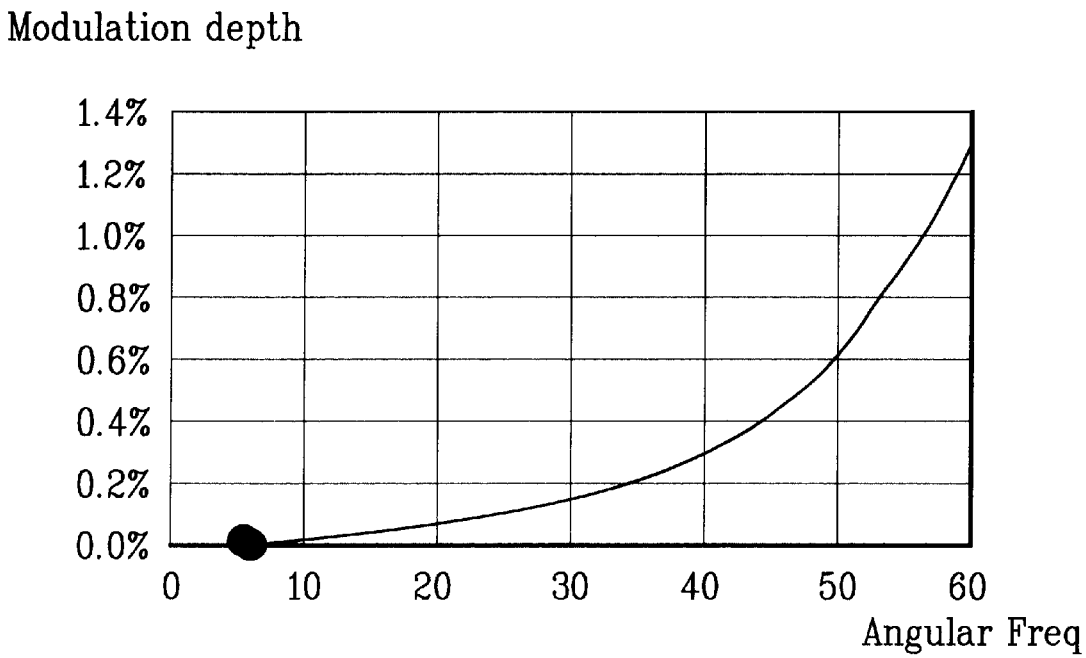
FIG. 5 is a graph illustrating the relation between the M(ξ,ζ) and CTF(ξ,ζ) at the time when the vertical pitch of the shadow mask in CPT having a length of 21 inches is 7 mm.

On the other hand, a probability that the bridge shadow is sensitive to the eyes of man is high, if the value of the $M(\xi,\zeta)/CTF(\xi,\zeta)$ is greater than '1', and the probability is low, if smaller than '1'. By way of example, in case where the vertical pitch of the shadow mask in the CPT having a length of 21 inches is 7 mm, as shown in FIG. 5, the vertical pitch of the apertures 7 formed on the shadow mask 5 satisfies the range of the above-mentioned predetermined value and hence, since the value of the $M(\xi,\zeta)/CTF(\xi,\zeta)$ is positioned right down the curve of CTF, the probability that the bridge shadow is sensitive to the eyes of man becomes low.

Therefore, in case where the vertical pitch a of the apertures 7 of the shadow mask 5 is in the range of the area calculated in the present invention, it is considerably large when compared to that of the apertures of the existing shadow mask, such that the luminance is increased, the phenomena of moire are reduced, and the probability that the bridge shadow is sensitive to the eyes of man is low, thereby enabling upgrading of the quality of the display device.

As apparent from the foregoing, a shadow mask for a flat cathode ray tube according to the present invention has the following advantages: the vertical pitch as a distance between center of apertures is optimally designed to thereby carry out the reduction of the phenomena of moire, the improvement of luminance and the removal of bridge shadow; and the interaction between the vertical pitch of the shadow mask and the vertical pitch of the electron beams scanned is made in a substantially inactive manner, such that the phenomena of moire are reduced, the luminance is increased and the probability that the bridge shadow is sensitive to the eyes of man is low, thereby enabling upgrading of the quality of the display device.

What is claimed is:

1. A shadow mask for a flat cathode ray tube having a panel glass with fluorescent materials spread on the inner surface thereof, a funnel glass fixed on the rear portion of said panel glass and having a neck portion as an integral body therewith to which an electron gun emitting electron beams to the fluorescent materials side is sealed, a deflection yoke formed on the outer peripheral surface of the neck portion and for deflecting the electron beams emitted from said electron gun, and said shadow mask fixed on the inner surface of said panel glass, having a color discrimination function and forming a plurality of slot type apertures on the surface thereof, characterized in that the relation between the vertical pitch of said apertures on said shadow mask and the vertical pitch of the electron beams scanned on a screen is in the range of $0.053 \leqq s/a \leqq 0.438$.

2. A shadow mask as claimed in claim 1, further characterized in that said relation is in the range of $0.098 \leqq s/a \leqq 0.369$.

* * * * *